US010219071B2

(12) United States Patent
Alderson

(10) Patent No.: US 10,219,071 B2
(45) Date of Patent: Feb. 26, 2019

(54) SYSTEMS AND METHODS FOR BANDLIMITING ANTI-NOISE IN PERSONAL AUDIO DEVICES HAVING ADAPTIVE NOISE CANCELLATION

(71) Applicant: Cirrus Logic, Inc., Austin, TX (US)

(72) Inventor: Jeffrey D. Alderson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 767 days.

(21) Appl. No.: 14/101,955

(22) Filed: Dec. 10, 2013

(65) Prior Publication Data

US 2015/0163592 A1 Jun. 11, 2015

(51) Int. Cl.
*H04R 3/00* (2006.01)
*G10K 11/178* (2006.01)

(52) U.S. Cl.
CPC ..... *H04R 3/002* (2013.01); *G10K 11/178* (2013.01); *G10K 11/1784* (2013.01); *G10K 2210/3017* (2013.01); *G10K 2210/3051* (2013.01); *H04R 2410/03* (2013.01)

(58) Field of Classification Search
CPC ..... G10K 11/1784; G10K 2210/3051; G10K 2210/3017; H04R 3/002; H04R 2410/03
See application file for complete search history.

(56) References Cited

U.S. PATENT DOCUMENTS 4,649,507 A 3/1987 Inaba et al.
5,117,401 A 5/1992 Feintuch
5,204,827 A 4/1993 Fujita et al.
5,251,263 A 10/1993 Andrea et al.
5,272,656 A 12/1993 Genereux
5,278,913 A 1/1994 Delfosse et al.
5,321,759 A 6/1994 Yuan
5,337,365 A 8/1994 Hamabe et al.
(Continued)

FOREIGN PATENT DOCUMENTS

CN 101552939 A 10/2009
CN 105284126 A 1/2016
(Continued)

OTHER PUBLICATIONS

Parkins, et al., Narrowband and broadband active control in an enclosure using the acoustic energy density, J. Acoust. Soc. Am. Jul. 2000, pp. 192-203, vol. 108, issue 1, U.S.
(Continued)

*Primary Examiner* — Ping Lee
(74) *Attorney, Agent, or Firm* — Jackson Walker L.L.P.

(57) ABSTRACT

A method may include adaptively generating an anti-noise signal from filtering a reference microphone signal with an adaptive filter in conformity with an error microphone signal and the reference microphone signal. The method may also include adjusting the response of the adaptive filter by combining injected noise with the reference microphone signal and receiving the injected noise by a copy of the adaptive filter so that the response of the copy is controlled by the adaptive filter adapting to cancel a combination of the ambient audio sounds and the injected noise and controlling the response of the adaptive filter with the coefficients adapted in the copy, whereby the injected noise is not present in the anti-noise signal and wherein each of a sample rate of the copy and a rate of adapting of the adaptive filter is significantly less than a sample rate of the adaptive filter.

16 Claims, 6 Drawing Sheets

(56) References Cited

U.S. PATENT DOCUMENTS 5,359,662 A 10/1994 Yuan et al.
5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
5,563,819 A 10/1996 Nelson
5,586,190 A 12/1996 Trantow et al.
5,633,795 A 5/1997 Popovich
5,640,450 A 6/1997 Watanabe
5,668,747 A 9/1997 Ohashi
5,696,831 A 12/1997 Inanga
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,185,300 B1 2/2001 Romesburg
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,110,864 B2 9/2006 Restrepo et al.
7,181,030 B2 2/2007 Rasmussen et al.
7,330,739 B2 2/2008 Somayajula
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,107,637 B2 1/2012 Asada et al.
8,144,888 B2 3/2012 Berkhoff et al.
8,155,334 B2 4/2012 Joho et al.
8,165,313 B2 4/2012 Carreras
8,249,262 B2 8/2012 Chua et al.
8,254,589 B2 8/2012 Mitsuhata
8,290,537 B2 10/2012 Lee et al.
8,311,243 B2 11/2012 Tucker et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,401,204 B2 3/2013 Odent et al.
8,411,872 B2 4/2013 Stothers et al.
8,442,251 B2 5/2013 Jensen et al.
8,526,627 B2 9/2013 Asao et al.
8,526,628 B1 9/2013 Massie et al.
8,532,310 B2 9/2013 Gauger, Jr. et al.
8,539,012 B2 9/2013 Clark
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermech et al.
9,094,744 B1 7/2015 Lu et al.
9,106,989 B2 8/2015 Li et al.
9,107,010 B2 8/2015 Abdollahzadeh Milani et al.
9,203,366 B2 12/2015 Eastty
9,264,808 B2 2/2016 Zhou et al.
9,294,836 B2 3/2016 Zhou et al.
9,392,364 B1 7/2016 Milani et al.
9,460,701 B2 10/2016 Yong et al.
9,462,376 B2 10/2016 Alderson
9,478,210 B2 10/2016 Hellman
9,478,212 B1 10/2016 Sorensen et al.
9,479,860 B2 10/2016 Kwatra et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0017921 A1 1/2004 Mantovani
2004/0047464 A1 3/2004 Yu et al.
2004/0120535 A1 6/2004 Woods
2004/0122879 A1 6/2004 McGrath
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0110568 A1 5/2005 Robinson et al.
2005/0117754 A1 6/2005 Sakawaki
2005/0175187 A1 8/2005 Wright et al.
2005/0207585 A1 9/2005 Christoph
2005/0240401 A1 10/2005 Ebenezer
2006/0013408 A1 1/2006 Lee
2006/0018460 A1 1/2006 McCree
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2007/0030989 A1 2/2007 Kates
2007/0033029 A1 2/2007 Sakawaki
2007/0038447 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0208520 A1 9/2007 Zhang et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.

(56) References Cited

U.S. PATENT DOCUMENTS

2008/0240455 A1 10/2008 Inoue et al.
2008/0240457 A1 10/2008 Innoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Shridhar et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0166206 A1 7/2010 Macours
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0226210 A1 9/2010 Kordis et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Marcel et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0091047 A1 4/2011 Konchitsky et al.
2011/0096933 A1 4/2011 Eastty
2011/0099010 A1 4/2011 Zhang
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0185524 A1 7/2012 Clark
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0022213 A1 1/2013 Alcock
2013/0083939 A1 4/2013 Fellers et al.
2013/0156238 A1 6/2013 Birch et al.
2013/0182792 A1 7/2013 Wyville
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270223 A1 9/2014 Li et al.
2014/0270224 A1 9/2014 Zhou et al.
2014/0277022 A1 9/2014 Hendrix et al.
2014/0294182 A1 10/2014 Axelsson
2014/0307887 A1 10/2014 Alderson
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1 10/2014 Zhang
2014/0341388 A1 11/2014 Goldstein
2014/0369517 A1 12/2014 Zhou et al.
2015/0078572 A1 3/2015 Abdollahzadeh Milani et al.
2015/0092953 A1 4/2015 Abdollahzadeh Milani et al.
2015/0104032 A1 4/2015 Kwatra et al.

(56) References Cited

U.S. PATENT DOCUMENTS

| | | | |
|---|---|---|---|
| 2015/0161980 | A1 | 6/2015 | Alderson et al. |
| 2015/0161981 | A1 | 6/2015 | Kwatra |
| 2015/0163592 | A1 | 6/2015 | Alderson |
| 2015/0195646 | A1 | 7/2015 | Kumar et al. |
| 2015/0256660 | A1 | 9/2015 | Kaller et al. |
| 2015/0256953 | A1 | 9/2015 | Kwatra et al. |
| 2015/0269926 | A1 | 9/2015 | Alderson et al. |
| 2015/0365761 | A1 | 12/2015 | Alderson et al. |
| 2016/0180830 | A1 | 6/2016 | Lu et al. |

FOREIGN PATENT DOCUMENTS

| | | | |
|---|---|---|---|
| CN | 105308678 | A | 2/2016 |
| CN | 105324810 | A | 2/2016 |
| CN | 10543170 | A | 3/2016 |
| CN | 10545387 | A | 3/2016 |
| DE | 102011013343 | A1 | 9/2012 |
| EP | 0412902 | A2 | 2/1991 |
| EP | 0756407 | A2 | 1/1997 |
| EP | 0898266 | A2 | 2/1999 |
| EP | 1691577 | A2 | 8/2006 |
| EP | 1880699 | A2 | 1/2008 |
| EP | 1921603 | A2 | 5/2008 |
| EP | 1947642 | A1 | 7/2008 |
| EP | 2133866 | A1 | 12/2009 |
| EP | 2237573 | A1 | 10/2010 |
| EP | 2259250 | A1 | 12/2010 |
| EP | 2216774 | A1 | 8/2011 |
| EP | 239550 | A1 | 12/2011 |
| EP | 2395501 | A1 | 12/2011 |
| EP | 2551845 | A1 | 1/2013 |
| EP | 2583074 | A1 | 4/2013 |
| EP | 2984648 | A2 | 2/2016 |
| EP | 2987160 | A1 | 2/2016 |
| EP | 2987162 | A1 | 2/2016 |
| EP | 2987337 | A1 | 2/2016 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| GB | 2539280 | A | 12/2016 |
| JP | 06006246 | | 1/1994 |
| JP | H06186985 | A | 7/1994 |
| JP | H06232755 | | 8/1994 |
| JP | 07098592 | | 4/1995 |
| JP | 07325588 | A | 12/1995 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | 93/04529 | A1 | 3/1993 |
| WO | 94/07212 | A1 | 3/1994 |
| WO | 1999011045 | | 3/1999 |
| WO | 2003015074 | A1 | 2/2003 |
| WO | 2003015275 | A1 | 2/2003 |
| WO | WO2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2013106370 | A1 | 7/2013 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |
| WO | 2016054186 | A1 | 4/2016 |
| WO | 2016100602 | A1 | 6/2016 |
| WO | 2016198481 | A2 | 12/2016 |

OTHER PUBLICATIONS

International Patent Application No. PCT/US2015/022113, International Search Report and Written Opinion, dated Jul. 23, 2015, 13 pages.

International Patent Application No. PCT/US2014/049600, International Search Report and Written Opinion, dated Jan. 14, 2015, 12 pages.

International Patent Application No. PCT/US2014/061753, International Search Report and Written Opinion, dated Feb. 9, 2015, 8 pages.

International Patent Application No. PCT/US2014/061548, International Search Report and Written Opinion, dated Feb. 12, 2015, 13 pages.

International Patent Application No. PCT/US2014/060277, International Search Report and Written Opinion, dated Mar. 9, 2015, 11 pages.

Kuo, Sen and Tsai, Jianming, Residual noise shaping technique for active noise control systems, J. Acoust. Soc. Am. 95 (3), Mar. 1994, pp. 1665-1668.

Combined Search and Examination Report, Application No. GB1512832.5, dated Jan. 28, 2016, 7 pages.

International Patent Application No. PCT/US2015/066260, International Search Report and Written Opinion, dated Apr. 21, 2016, 13 pages.

Combined Search and Examination Report, Application No. GB1519000.2, dated Apr. 21, 2016, 5 pages.

Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.

International Patent Application No. PCT/US2014/017112, International Search Report and Written Opinion, dated May 8, 2015, 22 pages.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, vol. 9, No. 1, Jan. 2002.

Martin, "Noise Power Spectral Density Estimation Based on Optimal Smoothing and Minimum Statistics", IEEE Trans. on Speech and Audio Processing, col. 9, No. 5, Jul. 2001.

(56) References Cited

OTHER PUBLICATIONS

Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, dated May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, dated Aug. 8, 2014, 22 pages.
International Search Report and Written Opinion of the International Searching Authority, International Patent Application No. PCT/US2014/018027, dated Sep. 4, 2014, 14 pages.
International Search Report and Written Opinion of the International Searching Authority, International Patent Application No. PCT/US2014/017374, dated Sep. 8, 2014, 13 pages.
International Search Report and Written Opinion of the International Searching Authority, International Patent Application No. PCT/US2014/019395, dated Sep. 9, 2014, 14 pages.
International Search Report and Written Opinion of the International Searching Authority, International Patent Application No. PCT/US2014/019469, dated Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, dated Oct. 18, 2014, 12 pages.
International Patent Application No. PCT/US2013/049407, International Search Report and Written Opinion, dated Jun. 18, 2014, 13 pages.
International Patent Application No. PCT/US2015/017124, International Search Report and Written Opinion, dated Jul. 13, 2015, 19 pages.
International Patent Application No. PCT/US2015/035073, International Search Report and Written Opinion, dated Oct. 8, 2015, 11 pages.
International Search Report and Written Opinion of the International Searching Authority, International Application No. PCT/EP2016/063079, dated Dec. 12, 2016.
Goeckler, H.G. et al.: Efficient Multirate Digital Filters Based on Fractional Polyphase Decomposition for Subnyquist Processing, Proceedings of the European Conference on Circuit Theory and Design, vol. 1, Jan. 1, 1999, pp. 409-412.
Examination Report under Section 18(3), United Kingdom Application No. GB1512832.5, dated Feb. 2, 2017.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

(56) References Cited

OTHER PUBLICATIONS

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

D. Senderowicz et al., "Low-Voltage Double-Sampled Delta-Sigma Converters," IEEE J. Solid-State Circuits, vol. 37, pp. 1215-1225, Dec. 1997, 13 pages.

P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.

Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.

Booji, P.S., Berkhoff, A.P., Virtual sensors for local, three dimensional, broadband multiple-channel active noise control and the effects on the quiet zones, Proceedings of ISMA2010 including USD2010, pp. 151-166.

SYSTEMS AND METHODS FOR BANDLIMITING ANTI-NOISE IN PERSONAL AUDIO DEVICES HAVING ADAPTIVE NOISE CANCELLATION

FIELD OF DISCLOSURE

The present disclosure relates in general to adaptive noise cancellation in connection with an acoustic transducer, and more particularly, to bandlimiting anti-noise in personal audio devices having adaptive noise cancellation.

BACKGROUND

Personal audio devices, such as mobile/cellular telephones, cordless telephones, and other consumer audio devices, such as MP3 players and headphones or earbuds, are in widespread use. Performance of such devices with respect to intelligibility can be improved by providing noise canceling using a microphone to measure ambient acoustic events and then using signal processing to insert an anti-noise signal into the output of the device to cancel the ambient acoustic events. Because the acoustic environment around personal audio devices such as wireless telephones can change dramatically, depending on the sources of noise that are present and the position of the device itself, it is desirable to adapt the noise canceling to take into account such environmental changes. However, adaptive noise canceling circuits can be complex, consume additional power and can generate undesirable results under certain circumstances.

Therefore, it would be desirable to provide a personal audio device, including a wireless telephone, that provides noise cancellation in a variable acoustic environment.

SUMMARY

In accordance with the teachings of the present disclosure, the disadvantages and problems associated with improving audio performance of a personal audio device may be reduced or eliminated.

In accordance with embodiments of the present disclosure, an integrated circuit for implementing at least a portion of a personal audio device may include an output, a reference microphone input, an error microphone input, and a processing circuit. The output may provide a signal to a transducer including both source audio for playback to a listener and an anti-noise signal for countering the effects of ambient audio sounds in an acoustic output of the transducer. The reference microphone input may receive a reference microphone signal indicative of the ambient audio sounds. The error microphone input may receive an error microphone signal indicative of the output of the transducer and the ambient audio sounds at the transducer. The processing circuit may implement an adaptive filter having a response that generates the anti-noise signal from the reference microphone signal to reduce the presence of the ambient audio sounds heard by the listener. The processing circuit may shape the response of the adaptive filter in conformity with the error microphone signal and the reference microphone signal by adapting the response of the adaptive filter to minimize the ambient audio sounds at the error microphone. The response of the adaptive filter may be further adjusted independent of the adapting by combining injected noise with the reference microphone signal and the processing circuit further implements a copy of the adaptive filter to receive the injected noise so that the response of the copy of the adaptive filter is controlled by the adaptive filter adapting to cancel a combination of the ambient audio sounds and the injected noise. The processing circuit may further control the response of the adaptive filter with the coefficients adapted in the copy of the adaptive filter, whereby the injected noise is not present in the anti-noise signal. Each of a sample rate of the copy of the adaptive filter and a rate of adapting of the adaptive filter may be significantly less than a sample rate of the adaptive filter.

In accordance with these and other embodiments of the present disclosure, an integrated circuit for implementing at least a portion of a personal audio device may include an output, a reference microphone input, an error microphone input, and a processing circuit. The output may provide a signal to a transducer including both source audio for playback to a listener and an anti-noise signal for countering the effects of ambient audio sounds in an acoustic output of the transducer. The reference microphone input may receive a reference microphone signal indicative of the ambient audio sounds. The error microphone input may receive an error microphone signal indicative of the output of the transducer and the ambient audio sounds at the transducer. The processing circuit may implement an adaptive filter having a response that generates the anti-noise signal from the reference microphone signal to reduce the presence of the ambient audio sounds heard by the listener. The processing circuit may shape the response of the adaptive filter in conformity with the error microphone signal and the reference microphone signal by adapting the response of the adaptive filter to minimize the ambient audio sounds at the error microphone. The response of the adaptive filter may be further adjusted independent of the adapting by combining injected noise with the reference microphone signal, and the processing circuit may further implement a copy of the adaptive filter to receive the injected noise so that the response of the copy of the adaptive filter is controlled by the adaptive filter adapting to cancel a combination of the ambient audio sounds and the injected noise. The processing circuit may further control the response of the adaptive filter with the coefficients adapted in the copy of the adaptive filter, whereby the injected noise is not present in the anti-noise signal. The injected noise may be provided by a periodic shaped noise signal stored in a buffer, such that the copy of the adaptive filter generates a periodic error noise signal from the periodic shaped noise signal, further such that the processing circuit shapes the response of the adaptive filter in conformity with a combination of the error microphone signal and the periodic error noise signal, and a combination of the periodic shaped noise signal and the reference microphone signal.

In accordance with these and other embodiments of the present disclosure, a method may include receiving a reference microphone signal indicative of ambient audio sounds at the acoustic output of a transducer and receiving an error microphone signal indicative of an acoustic output of a transducer and the ambient audio sounds at the acoustic output of the transducer. The method may also include generating an anti-noise signal from filtering the reference microphone signal with an adaptive filter to reduce the presence of the ambient audio sounds heard by the listener and shaping the response of the adaptive filter in conformity with the error microphone signal and the reference microphone signal by adapting the response of the adaptive filter to minimize the ambient audio sounds at the error microphone. The method may also include further adjusting the response of the adaptive filter by combining injected noise with the reference microphone signal and receiving the injected noise by a copy of the adaptive filter so that the response of the copy of the adaptive filter is controlled by the adaptive filter adapting to cancel a combination of the ambient audio sounds and the injected noise. The method may also include controlling the response of the adaptive filter with the coefficients adapted in the copy of the adaptive filter, whereby the injected noise is not present in the anti-noise signal and wherein each of a sample rate of the copy of the adaptive filter and a rate of adapting of the adaptive filter is significantly less than a sample rate of the adaptive filter.

In accordance with these and other embodiments of the present disclosure, a method may include receiving a reference microphone signal indicative of ambient audio sounds at the acoustic output of a transducer and receiving an error microphone signal indicative of an acoustic output of a transducer and the ambient audio sounds at the acoustic output of the transducer. The method may also include generating an anti-noise signal from filtering the reference microphone signal with an adaptive filter to reduce the presence of the ambient audio sounds heard by the listener and further adjusting the response of the adaptive filter by combining injected noise with the reference microphone signal. The method may also include receiving the injected noise by a copy of the adaptive filter so that the response of the copy of the adaptive filter is controlled by the adaptive filter adapting to cancel a combination of the ambient audio sounds and the injected noise and controlling the response of the adaptive filter with the coefficients adapted in the copy of the adaptive filter, whereby the injected noise is not present in the anti-noise signal and is provided by a periodic shaped noise signal stored in a buffer, such that the copy of the adaptive filter generates a periodic error noise signal from the periodic shaped noise signal. The method may additionally include shaping of the response of the adaptive filter in conformity with a combination of the error microphone signal and the periodic error noise signal, and a combination of the periodic shaped noise signal and the reference microphone signal.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
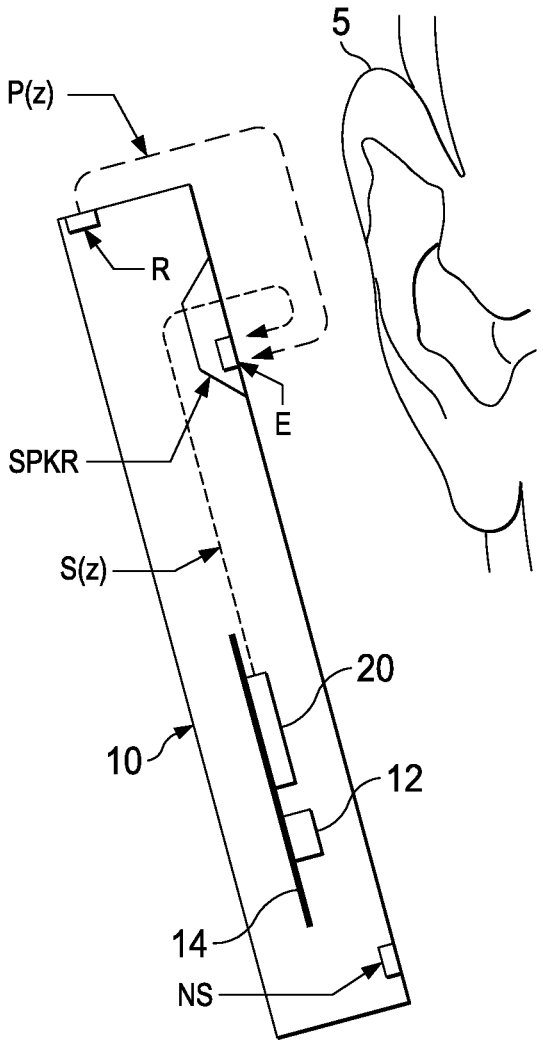
FIG. 1A is an illustration of an example personal audio device, in accordance with embodiments of the present disclosure.

Referring now to FIG. 1A, a personal audio device 10 as illustrated in accordance with embodiments of the present disclosure is shown in proximity to a human ear 5. Personal audio device 10 is an example of a device in which techniques in accordance with embodiments of the invention may be employed, but it is understood that not all of the elements or configurations embodied in illustrated personal audio device 10, or in the circuits depicted in subsequent illustrations, are required in order to practice the invention recited in the claims. Personal audio device 10 may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include adaptive noise cancellation (ANC) circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when personal audio device 10 is in close proximity to ear 5. Circuit 14 within personal audio device 10 may include an audio CODEC integrated circuit (IC) 20 that receives the signals from reference microphone R, near-speech microphone NS, and error microphone E, and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of personal audio device 10 adapt an anti-noise signal generated at the output of speaker SPKR from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. While the illustrated personal audio device 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes. In addition, although only one reference microphone R is depicted in FIG. 1, the circuits and techniques herein disclosed may be adapted, without changing the scope of the disclosure, to personal audio devices including a plurality of reference microphones.

Figure 1B:
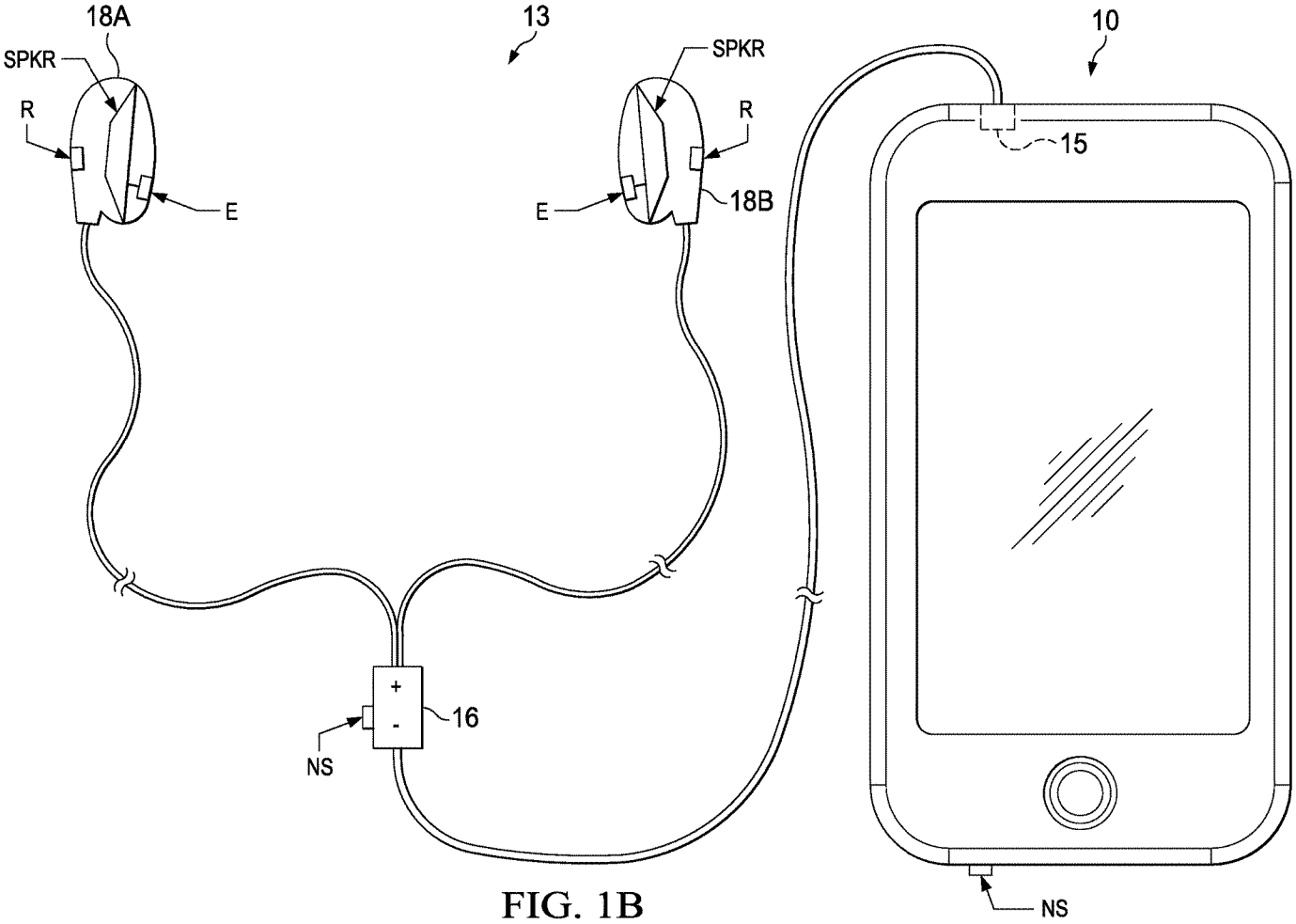
FIG. 1B is an illustration of an example personal audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear or ear canal, and includes without limitation earphones, earbuds, and other similar devices. As more specific non-limiting examples, "headphone," may refer to intra-canal earphones, intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

The various microphones referenced in this disclosure, including reference microphones, error microphones, and near-speech microphones, may comprise any system, device, or apparatus configured to convert sound incident at such microphone to an electrical signal that may be processed by a controller, and may include without limitation an electrostatic microphone, a condenser microphone, an electret microphone, an analog microelectromechanical systems (MEMS) microphone, a digital MEMS microphone, a piezoelectric microphone, a piezo-ceramic microphone, or dynamic microphone.

Figure 2:
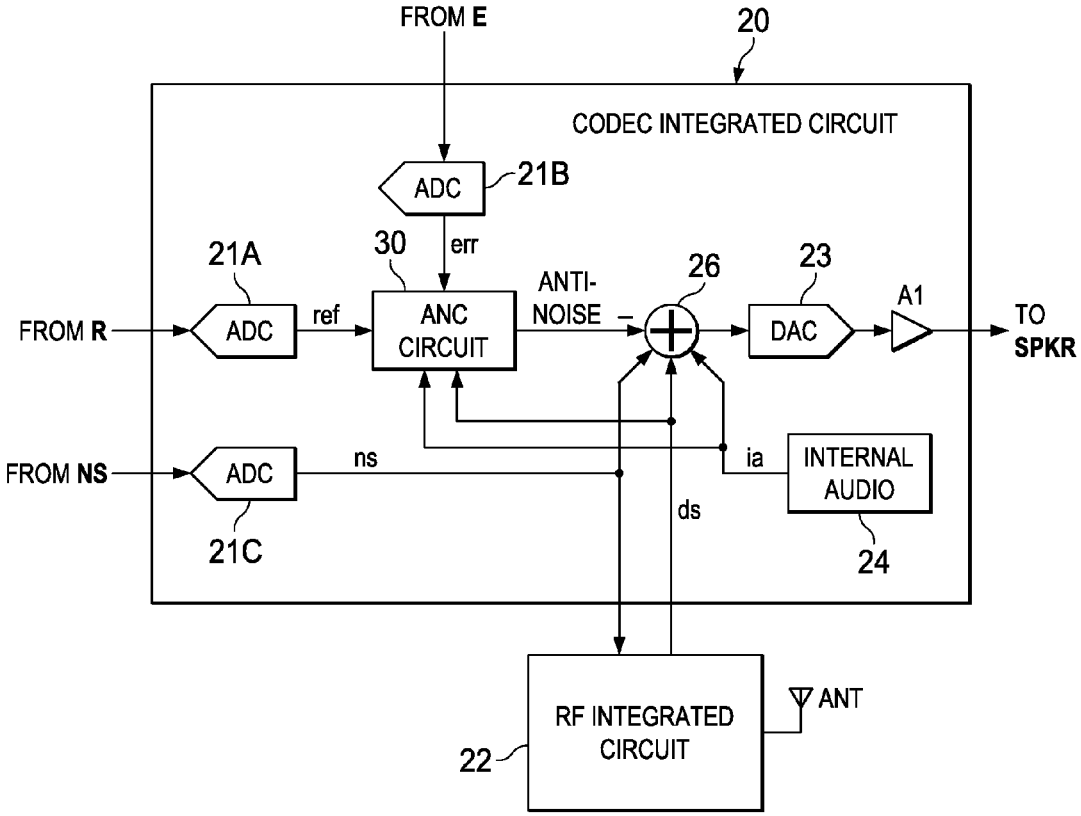
FIG. 2 is a block diagram of selected circuits within the personal audio device depicted in FIG. 1, in accordance with embodiments of the present disclosure.

Referring now to FIG. 2, selected circuits within personal audio device 10, which in other embodiments may be placed in whole or part in other locations such as one or more headphone assemblies 13, are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine a source audio signal from audio signals is from internal audio sources 24 and/or downlink speech ds which may be received from radio frequency (RF) integrated circuit 22, the anti-noise signal generated by ANC circuit 30, which by convention has the same polarity as the noise in reference microphone signal ref and is therefore subtracted by combiner 26, and a portion of near speech microphone signal ns so that the user of personal audio device 10 may hear his or her own voice in proper relation to downlink speech ds. Near speech microphone signal ns may also be provided to RF integrated circuit 22 and may be transmitted as uplink speech to the service provider via antenna ANT.

Figure 3A:
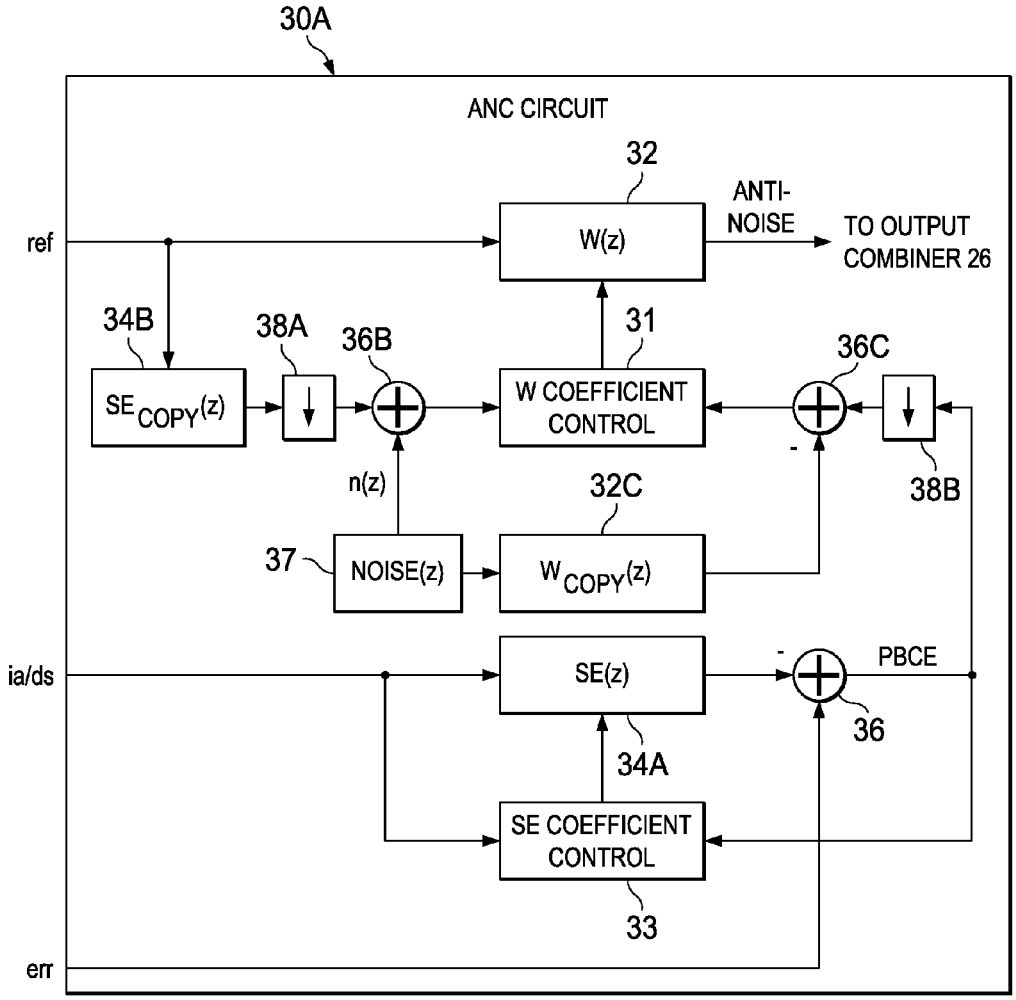
FIG. 3A is a block diagram depicting selected signal processing circuits and functional blocks within an example active noise canceling (ANC) circuit of a coder-decoder (CODEC) integrated circuit of FIG. 2, in accordance with embodiments of the present disclosure.

Referring now to FIG. 3A, details of ANC circuit 30A are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be a noise-modified reference microphone signal and a noise-modified playback corrected error. The noise-modified reference microphone signal may comprise reference microphone signal ref as shaped by a copy of an estimate of the response of path S(z) provided by filter 34B and as decimated by decimator 38A (in accordance with further description below) combined with a noise signal n(z) (also as described in further detail below). The noise-modified playback corrected error may be generated as described in greater detail below. Filter 34B may not be an adaptive filter, per se, but may have an adjustable response that is tuned to match the response of adaptive filter 34A described below, so that the response of filter 34B tracks the adapting of adaptive filter 34A.

By transforming reference microphone signal ref with a copy of the estimate of the response of path S(z), response $SE_{COPY}(z)$ of filter 34B, and minimizing the difference between the resultant noise-modified reference microphone signal and the noise-modified playback corrected error based on error microphone signal err, adaptive filter 32 may adapt to the desired response of P(z)/S(z). The noise-modified playback corrected error signal compared to noise-modified reference microphone signal by W coefficient control block 31 may be derived from a playback corrected error (labeled as "PBCE" in FIG. 3) which may be equal to error microphone signal err combined (e.g., by combiner 36) with an inverted amount of source audio signal (e.g., downlink audio signal ds and/or internal audio signal ia), that has been processed by filter response SE(z) of filter 34A, of which response $SE_{COPY}(z)$ is a copy. By injecting an inverted amount of source audio signal, adaptive filter 32 may be prevented from adapting to the relatively large amount of source audio signal present in error microphone signal err. However, by transforming that inverted copy of source audio signal with the estimate of the response of path S(z), the source audio that is removed from error microphone signal err to generate the playback corrected error should match the expected version of the source audio signal reproduced at error microphone signal err, because the electrical and acoustical path of S(z) is the path taken by the source audio signal to arrive at error microphone E.

To implement the above, adaptive filter 34A may have coefficients controlled by SE coefficient control block 33, which may compare the source audio signal and the playback corrected error. SE coefficient control block 33 may correlate the actual source audio signal with the components of the source audio signal that are present in error microphone signal err. Adaptive filter 34A may thereby be adapted to generate a secondary estimate signal from the source audio signal, that when subtracted from error microphone signal err to generate the playback corrected error, includes the content of error microphone signal err that is not due to the source audio signal.

As mentioned above, ANC circuit 30A may inject a noise signal n(z) using a noise generator 37 that may be supplied to a copy $W_{COPY}(z)$ of the response W(z) of adaptive filter 32 provided by an adaptive filter 32C. A combiner 36B may add noise signal n(z) to the output of adaptive filter 34B provided to W coefficient control 31. Noise signal n(z), as shaped by filter 32C, may be subtracted from the output of combiner 36 by a combiner 36C so that noise signal n(z) is asymmetrically added to the correlation inputs to W coefficient control 31, with the result that the response W(z) of adaptive filter 32 may be biased by the completely correlated injection of noise signal n(z) to each correlation input to W coefficient control 31. Because the injected noise appears directly at the reference input to W coefficient control 31, does not appear in error microphone signal err, and only appears at the other input to W coefficient control 31 via the combining of the filtered noise at the output of filter 32C by combiner 36C, W coefficient control 31 may adapt W(z) to attenuate the frequencies present in noise signal n(z). The content of noise signal n(z) may not appear in the anti-noise signal, only in the response W(z) of adaptive filter 32 which may have amplitude decreases at the frequencies/bands in which noise signal n(z) has energy. For example, if it is desirable to decrease the response of W(z) in the vicinity of 1 kHz, noise signal n(z) can be generated to have a spectrum that has energy at 1 kHz, which will cause W coefficient control 31 to decrease the gain of adaptive filter 32 at 1 kHz in an attempt to cancel an apparent source of ambient acoustic sound due to injected noise signal n(z).

Implementation of noise signal n(z), filter 32C, and W coefficient control 31 may require significant processing resources, especially if such elements are operated at the same bandwidth as response W(z) of filter 32, and thus, addition and processing of such injected noise may contribute significantly to expense of producing a personal audio device including such an ANC circuit 30A. Such processing complexity and related expense may be reduced by implementation of a decimator 38A which may decimate reference microphone signal ref prior to its combination with noise signal n(z) by combiner 36B. Similarly, decimator 38B may decimate the playback corrected error prior to its combination with the noise signal n(z) as filtered by filter 32C. Because of the presence of decimators 38A and 38B, each of a sample rate of filter 32C and a rate of adapting of adaptive filter 32 (as controlled by W coefficient control block 31) may be significantly less (e.g., at least one order of magnitude less) than a sample rate of the adaptive filter. For example, in some embodiments filter 32 may sample at a rate of 1.5 MHz while noise generator 37, W coefficient control block 31, and filter 32C may operate at 48 kHz.

Figure 3B:
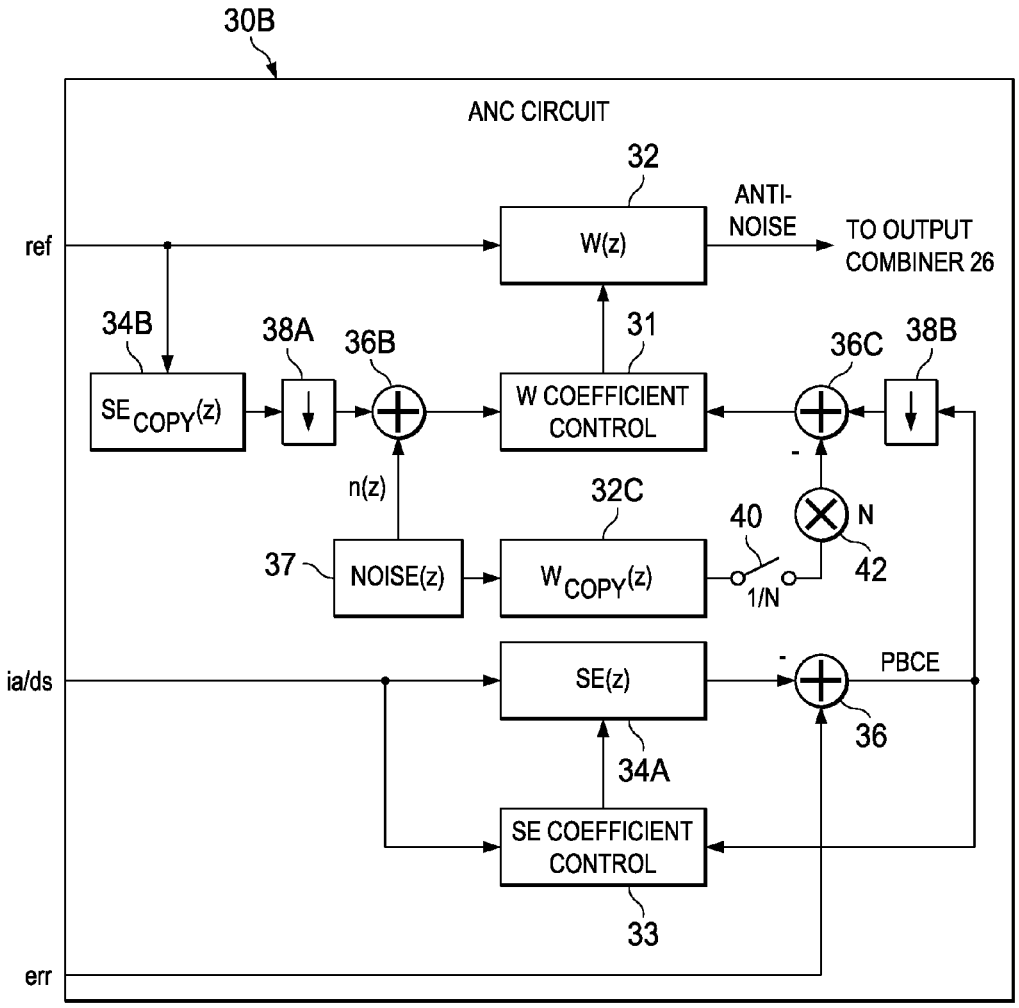
FIG. 3B is a block diagram depicting selected signal processing circuits and functional blocks within another example ANC circuit of CODEC integrated circuit of FIG. 2, in accordance with embodiments of the present disclosure.

Referring now to FIG. 3B, details of another ANC circuit 30B are shown in accordance with an alternative embodiment of the present disclosure that may be used to implement ANC circuit 30 of FIG. 2. ANC circuit 30B is similar to ANC circuit 30A of FIG. 3A, so only differences between them will be described below. In ANC circuit 30B, noise signal n(z) may be continuously injected into combiner 36B, but may be only periodically added at combiner 36C. Thus, a switch 40 or other suitable component may be added such that filtered noise from filter 32C is added once every N samples. N may comprise any suitable integer number (e.g., 2 through 16). In addition, a multiplier 42 may be added to the path of the filtered noise such that the noise added each N samples is multiplied by N such that the noise-modified playback corrected error received at coefficient control block 31 is a reasonable estimate of the unfiltered noise injected into the noise-modified reference microphone signal. Accordingly, the sampling rate of filter 32C may be further significantly reduced (e.g., by a factor of 2 or more) beyond that described above in reference to ANC circuit 30A. For example, in some embodiments filter 32 may sample at a rate of 1.5 MHz, while noise generator 37 and W coefficient control block 31 may operate at 48 kHz, and filter 32C may operate at 48 kHz/N.

Figure 3C:
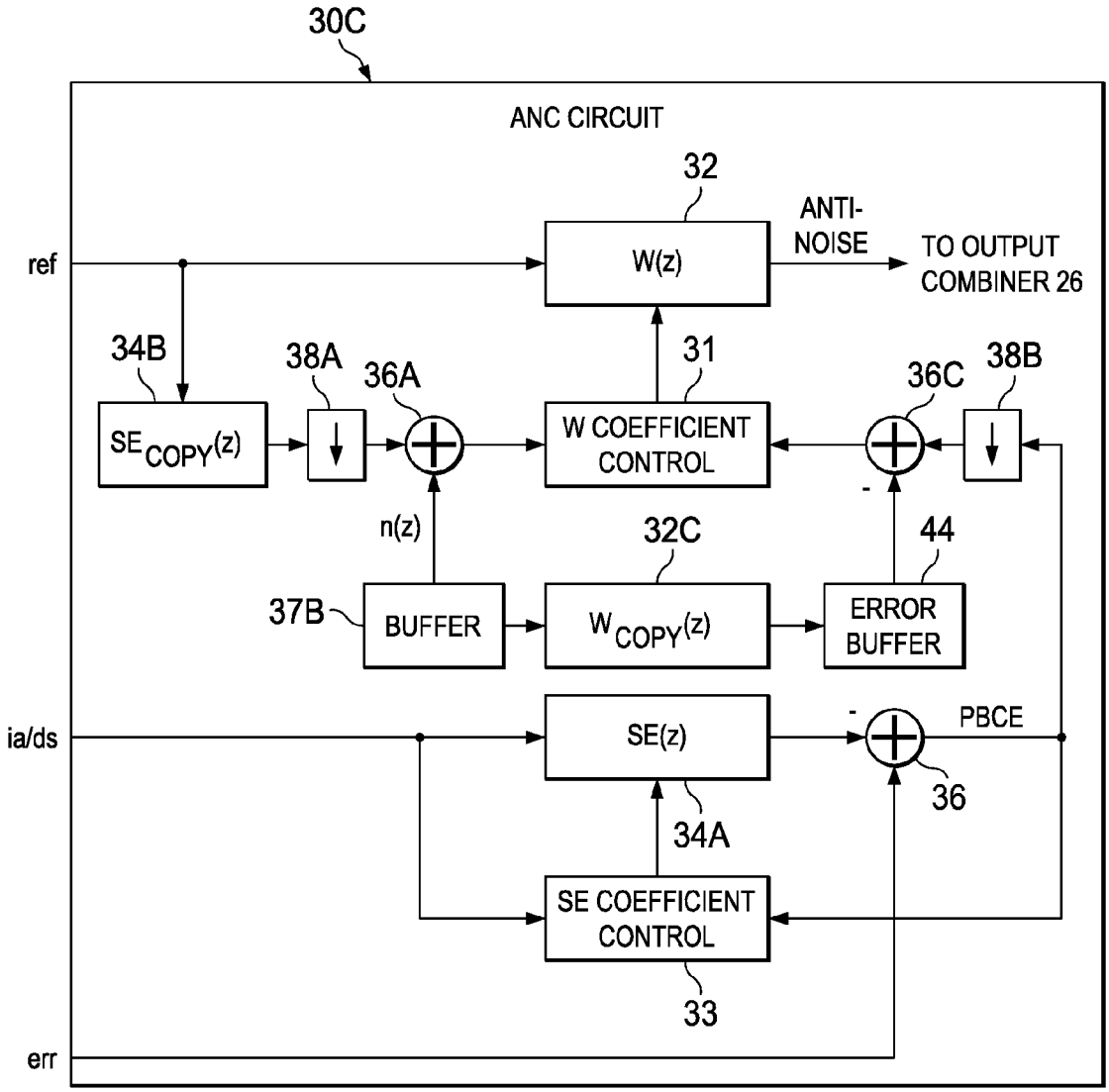
FIG. 3C is a block diagram depicting selected signal processing circuits and functional blocks within yet another example ANC circuit of CODEC integrated circuit of FIG. 2, in accordance with embodiments of the present disclosure.

Referring now to FIG. 3C, details of another ANC circuit 30C are shown in accordance with an alternative embodiment of the present disclosure that may be used to implement ANC circuit 30 of FIG. 2. ANC circuit 30C is similar to ANC circuit 30A of FIG. 3A, so only differences between them will be described below. In ANC circuit 30C, instead of generating noise by noise generator 37 and filtering it, shaped noise itself may be stored in noise buffer 37B. In some embodiments, the shaped noise may be made periodic, for example, by taking a magnitude and phase response of a signal in a multiple-point fast Fourier transform and storing the inverse fast Fourier transform of the response in noise buffer 37B. Because filter 32C is, in some embodiments, a finite impulse response filter that slowly changes, the periodic shaped noise signal output by noise buffer 37B may be filtered by filter 32C, resulting in a periodic error noise signal output by filter 32C and stored in error buffer 44, assuming the response W(z) of filter 32C did not change. Such periodic error noise signal may be subtracted from the decimated playback corrected error by combiner 36C to generate the noise-modified playback corrected error applied to W coefficient control block 31. ANC circuit 30C may from time-to-time recompute the periodic error noise signal and store the recomputed periodic error noise signal in error buffer 44. For example, in some embodiments, ANC circuit 30C may recompute the periodic error noise signal and store the recomputed periodic error noise signal in error buffer 44 responsive to a substantial change in response $W_{COPY}(z)$ of filter 32C. In these and other embodiments, ANC circuit 30C may recompute the periodic error noise signal and store the recomputed periodic error noise signal in error buffer 44 at periodic intervals less than the sample rate of the sample rate of filter 32C (e.g., every 100 milliseconds).

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing a signal to a transducer including both source audio for playback to a listener and an anti-noise signal for countering the effects of ambient audio sounds in an acoustic output of the transducer;

a reference microphone input for receiving a reference microphone signal indicative of the ambient audio sounds;

an error microphone input for receiving an error microphone signal indicative of the acoustic output of the transducer and the ambient audio sounds at the transducer; and a processing circuit that implements an adaptive filter having a response that generates the anti-noise signal from the reference microphone signal to reduce the presence of the ambient audio sounds heard by the listener, wherein:

the processing circuit shapes the response of the adaptive filter in conformity with the error microphone signal and the reference microphone signal by adapting the response of the adaptive filter to minimize the ambient audio sounds present in the error microphone signal;

the response of the adaptive filter is further adjusted independent of the adapting by combining injected noise with the reference microphone signal and the processing circuit further implements a copy of the adaptive filter to receive the injected noise so that the response of the copy of the adaptive filter is controlled by the adaptive filter adapting to cancel a combination of the ambient audio sounds and the injected noise;

the processing circuit further controls the response of the adaptive filter with the coefficients adapted in the copy of the adaptive filter, whereby the injected noise is not present in the anti-noise signal; and each of a sample rate of the copy of the adaptive filter and a rate of adapting of the adaptive filter is significantly less than a sample rate of the adaptive filter and the sample rate of the copy of the adaptive filter is significantly less than the rate of adapting of the adaptive filter.

2. The integrated circuit of claim 1, wherein the processing circuit further implements a first decimator for decimating the reference microphone signal to the sample rate of the copy of the adaptive filter and a second decimator for decimating the error microphone signal to the sample rate of the copy of the adaptive filter, such that the processing circuit shapes the response of the adaptive filter in conformity with the decimated error microphone signal and the decimated reference microphone signal.

3. The integrated circuit of claim 1, wherein the processing circuit shapes the response of the adaptive filter in conformity with a first signal combining the reference microphone signal with the injected noise and a second signal comprising the error microphone signal combined with a periodic sample of the injected noise filtered by the copy of the adaptive filter.

4. The integrated circuit of claim 1, wherein the response of the adaptive filter is reduced in frequency regions in a frequency range of the injected noise.

5. The integrated circuit of claim 1, wherein the injected noise is provided by a periodic shaped noise signal stored in a buffer, such that the copy of the adaptive filter generates a periodic error noise signal from the periodic shaped noise signal, further such that the processing circuit shapes the response of the adaptive filter in conformity with a combination of the error microphone signal and the periodic error noise signal, and a combination of the periodic shaped noise signal and the reference microphone signal.

6. The integrated circuit of claim 5, wherein the processing circuit stores the periodic error noise signal in a second buffer, such that the processing circuit shapes the response of the adaptive filter in conformity with a combination of the error microphone signal, the periodic error noise signal stored in the buffer, and a combination of the periodic shaped noise signal and the reference microphone signal.

7. The integrated circuit of claim 6, wherein the processing circuit updates the second buffer with the periodic error noise signal responsive to a substantial change in the response of the adaptive filter.

8. The integrated circuit of claim 6, wherein the processing circuit updates the second buffer at periodic intervals, wherein the frequency of the periodic intervals is significantly less than a sample rate of the copy of the adaptive filter.

9. A method comprising:

receiving a reference microphone signal indicative of ambient audio sounds at the acoustic output of a transducer;

receiving an error microphone signal indicative of an acoustic output of the transducer and the ambient audio sounds at the acoustic output of the transducer;

generating an anti-noise signal from filtering the reference microphone signal with an adaptive filter to reduce the presence of the ambient audio sounds heard by a listener and shaping a response of the adaptive filter in conformity with the error microphone signal and the reference microphone signal by adapting the response of the adaptive filter to minimize the ambient audio sounds present in the error microphone signal;

further adjusting the response of the adaptive filter by combining injected noise with the reference microphone signal;

receiving the injected noise by a copy of the adaptive filter so that the response of the copy of the adaptive filter is controlled by the adaptive filter adapting to cancel a combination of the ambient audio sounds and the injected noise; and controlling the response of the adaptive filter with the coefficients adapted in the copy of the adaptive filter, whereby the injected noise is not present in the anti-noise signal;

wherein each of a sample rate of the copy of the adaptive filter and a rate of adapting of the adaptive filter is significantly less than a sample rate of the adaptive filter and the sample rate of the copy of the adaptive filter is significantly less than the rate of adapting of the adaptive filter.

10. The method of claim 9, further comprising decimating the reference microphone signal to the sample rate of the copy of the adaptive filter; and decimating the error microphone signal to the sample rate of the copy of the adaptive filter, such that the processing circuit shapes the response of the adaptive filter in conformity with the decimated error microphone signal and the decimated reference microphone signal.

11. The method of claim 9, wherein shaping the response of the adaptive filter comprises shaping the response of the adaptive filter in conformity with a first signal combining the reference microphone signal with the injected noise and a second signal comprising the error microphone signal combined with a periodic sample of the injected noise filtered by the copy of the adaptive filter.

12. The method of claim 9, wherein the response of the adaptive filter is reduced in frequency regions in a frequency range of the injected noise.

13. The method of claim 9, wherein:

the injected noise is not present in the anti-noise signal and is provided by a periodic shaped noise signal stored in a buffer, such that the copy of the adaptive filter generates a periodic error noise signal from the periodic shaped noise signal; and the method further comprise shaping of the response of the adaptive filter in conformity with a combination of the error microphone signal and the periodic error noise signal, and a combination of the periodic shaped noise signal and the reference microphone signal.

14. The method of claim 13, further comprising storing the periodic error noise signal in a second buffer, such that the response of the adaptive filter is shaped in conformity with a combination of the error microphone signal, the periodic error noise signal stored in the buffer, and a combination of the periodic shaped noise signal and the reference microphone signal.

15. The method of claim 14, further comprising updating the second buffer with the periodic error noise signal responsive to a substantial change in the response of the adaptive filter.

16. The method of claim 14, further comprising updating the second buffer at periodic intervals, wherein the frequency of the periodic intervals is significantly less than a sample rate of the copy of the adaptive filter.

* * * * *